US007658507B1

(12) United States Patent
Thomas

(10) Patent No.: US 7,658,507 B1
(45) Date of Patent: Feb. 9, 2010

(54) IMAGE PRODUCING CANDLE APPARATUS

(76) Inventor: Shepard H. Thomas, 10918 Jardin Way, Charlotte, NC (US) 28215

( * ) Notice: Subject to any disclaimer, the term of this patent is extended or adjusted under 35 U.S.C. 154(b) by 104 days.

(21) Appl. No.: 12/022,494

(22) Filed: Jan. 30, 2008

(51) Int. Cl.
*F21L 19/00* (2006.01)
*F21V 35/00* (2006.01)

(52) U.S. Cl. ..... 362/161; 362/35; 362/806; 40/441; 431/126; 446/210

(58) Field of Classification Search ..... 362/35, 362/161–163, 177, 232, 806; 40/412, 422, 40/439–441; 431/126, 288, 310; 446/210
See application file for complete search history.

(56) References Cited

U.S. PATENT DOCUMENTS 5,860,725 A * 1/1999 Zer et al. ..... 362/35
6,783,356 B2 * 8/2004 Hermanson ..... 431/126
7,168,948 B2 * 1/2007 Swearingen et al. ..... 431/126

* cited by examiner

*Primary Examiner*—Jason M Han

(57) ABSTRACT

An image projecting candle apparatus which is constructed of a generally elongated cylindrical body with a candle positioned therein and an annular display unit mounted on a top rim of the cylindrical body with colored transparent film mounted in the display unit and for turning by heated air rising out of the cylindrical body such that a team color of a person's favorite sports team can be projected either on the ceiling or on a wall.

8 Claims, 3 Drawing Sheets

IMAGE PRODUCING CANDLE APPARATUS

FIELD OF THE INVENTION

The present invention generally relates to a decorative item and more particularly, relates to an image projecting candle apparatus for projecting the color of a specific sports team onto the ceiling or the wall.

BACKGROUND OF THE INVENTION

Professional and college sports are popular past times for a large segment of the population here in the United States. Each person may have a favorite sports team, regardless of a college or of a professional team associated with a city. Each sports team usually has a specific color related to and representative of the team. For the sports enthusiasts, it would be desirable that a decorative lighting apparatus is provided such that the specific color of his favorite sports team can be projected either onto the ceiling or onto the wall of a room.

It is therefore an object of the present invention to provide an image projecting candle apparatus that is capable of projecting a color of a specific sports team.

It is another object of the present invention to provide an image projecting candle apparatus that is capable of projecting different colors by interchangeable display unit on the candle apparatus.

SUMMARY OF THE INVENTION

In accordance with the present invention, an image projecting candle apparatus for projecting the color of a person's favorite sports team is provided.

In a preferred embodiment, the present invention image projecting candle can be constructed of a generally elongated cylindrical body with a cavity therein and an open top defined by a top rim and a first diameter; a candle positioned in the cavity; an annular display unit formed of a rigid outer rim, a center post and four 90° fan-shaped segments each formed of a colored transparent film mounted between the outer rim and the center post at an angle between 3° and 20°, the annular display unit having a second diameter that is not larger than ½ of said first diameter for the cylindrical body; a mounting aperture on an outer peripheral surface of the top rim of the cylindrical body for receiving the center post of the display unit and allowing the same to rotate upon an upward movement of heated air from a lighted candle.

BRIEF DESCRIPTION OF THE DRAWINGS

The invention will now be described, by way of example, with reference to the accompanying drawings, in which.

DETAILED DESCRIPTION OF THE PREFERRED EMBODIMENT

The present invention discloses an image projecting candle apparatus for projecting a specific color image on the ceiling or the wall of a person's favorite sports team.

The present invention image projecting candle apparatus is a specially designed candle kit for sports enthusiasts. The apparatus adds an attractive touch to any décor and allows individuals to show support for his favorite teams in an eye-catching manner. It is a kit that is constructed of a glass or acrylic cylindrical-shaped holder, a candle, and a color display unit which is equipped with four interchangeable fan sections. The color display unit is snapped into the top lid of the candle and rotate to shine a particular team colors onto the ceiling, the walls, etc. The unit rotates with the convection of heat from a burning candle. Optionally, a small, battery operated motor can be provided for turning the annular display unit. An optional base can also be provided which is equipped with a built-in recording of a particular college, professional team sound, cheers, etc. The candle can also be colored to match the team's color. The scent of the candle can also be varied. The candle holder can be imprinted with the various names and logos of sports teams. The present invention image projecting candle apparatus can be offered in a wide range of designs for various sports, including but not limited to football, soccer, hockey, and baseball. The cylindrical unit measures about 10 inches high and about 3½ inches wide can be produced in a various sizes, shapes, colors, scents, and from different materials.

The present invention image projecting candle apparatus fulfills the need for an innovative way to display team pride and allegiance. The appealing features of the image projecting apparatus are its novelty, eye-catching design, attractiveness, decorative appeal, versatility, ease of use, and convenience. The product can provide enhanced visual appeal that can be more stimulating and interesting than traditional candles. An individual can easily decorate his or her home in support of a favorite player or team with the use of this candle. The novel design of the candle enhances the atmosphere of any room in a home or even in an office.

Figure 1:
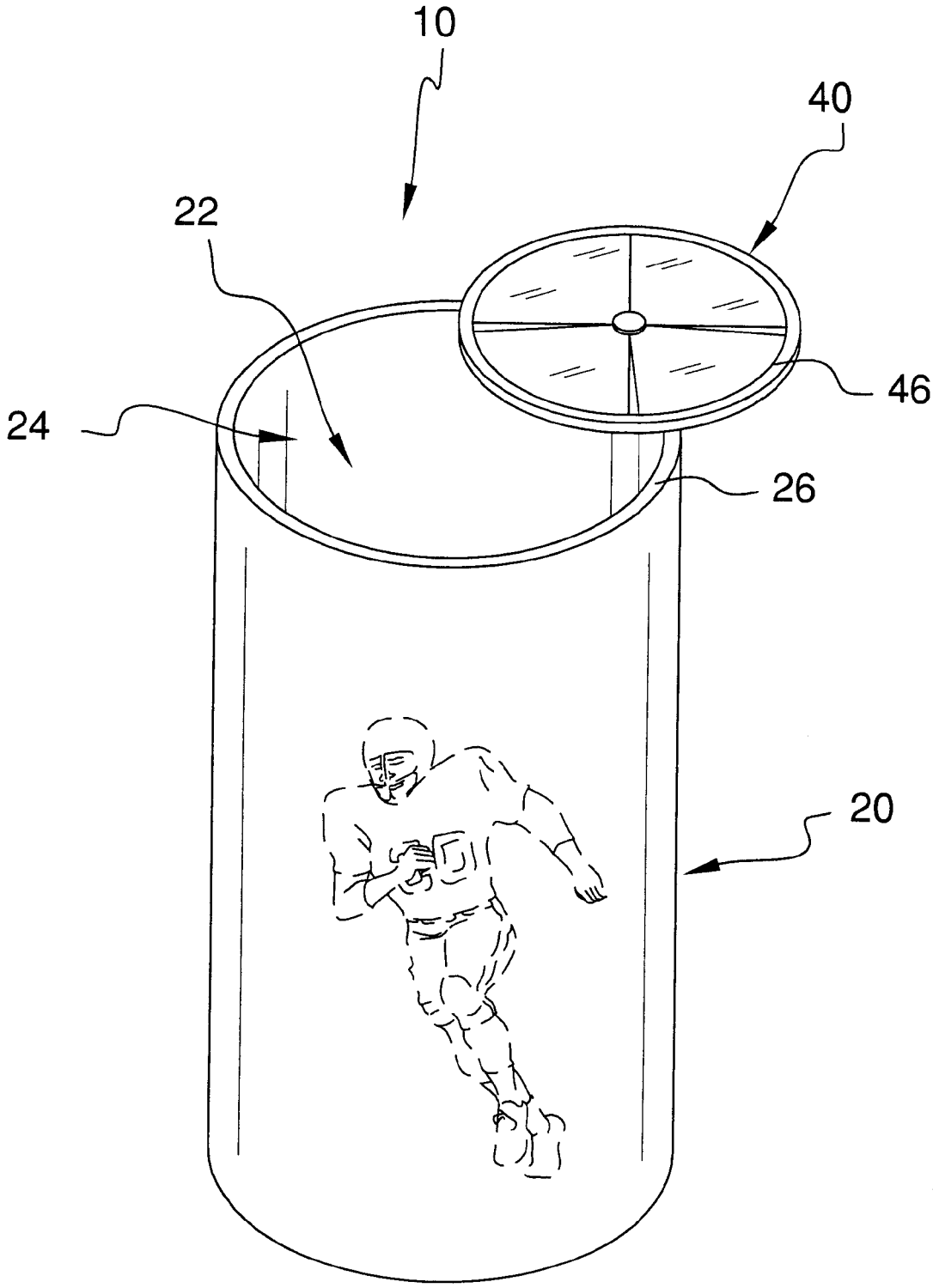
FIG. 1 is a perspective view of the present invention image projecting candle apparatus.
Figure 2:
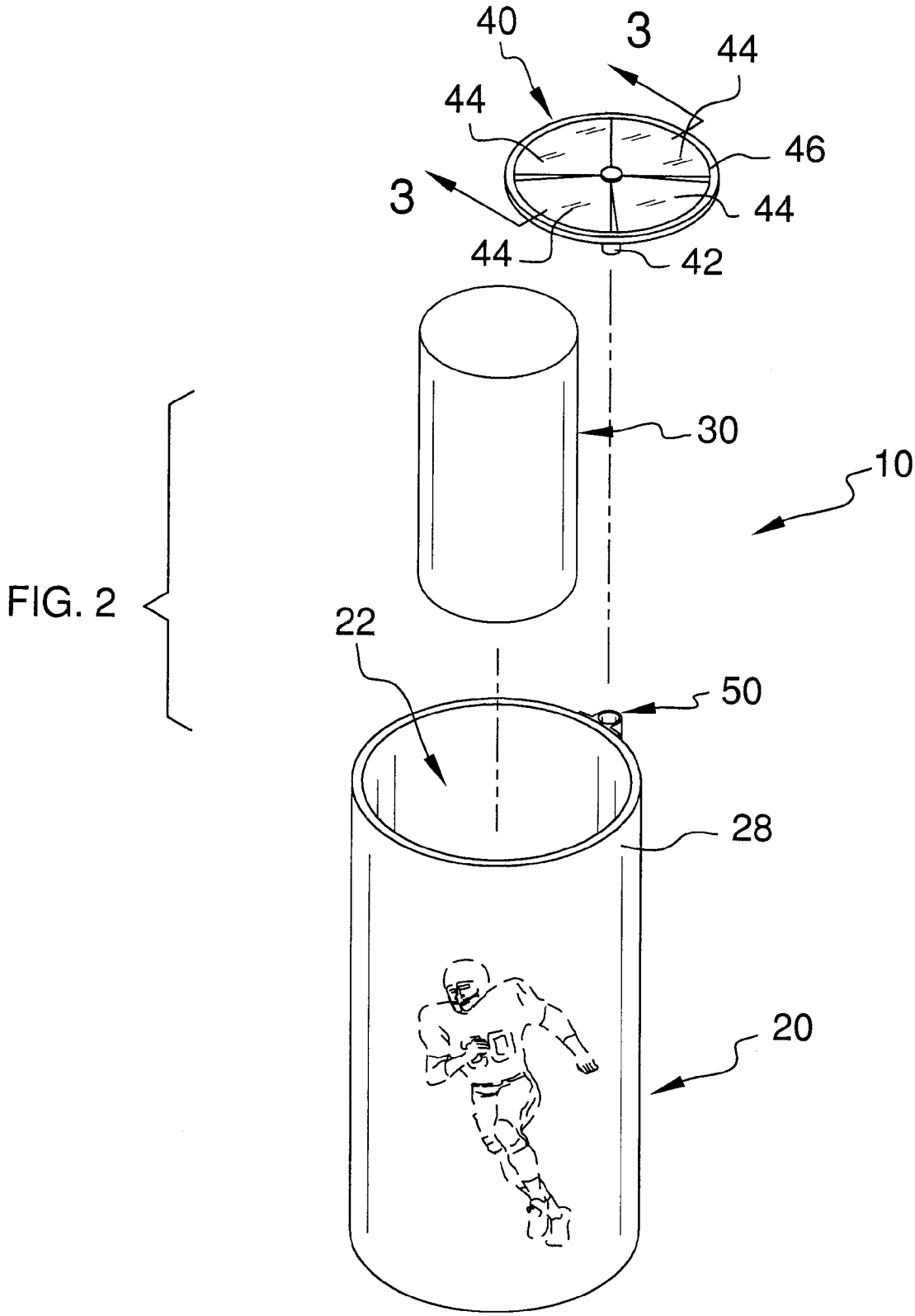
FIG. 2 is a perspective view of the present invention image projecting candle apparatus with the candle and the display unit removed.

Referring initially to FIG. 1, wherein a perspective view of the present invention image projecting candle 10 is shown. The image projecting candle 10 is constructed of a generally elongated cylindrical body 20 which has a cavity 22 therein and an open top 24 defined by a top rim 26 and a first diameter. A candle 30 is positioned in the cavity 22, as shown in FIG. 2. An annular display unit 40 which is formed of a rigid outer rim 46 a center post 42 and four 90° fan-shaped segments 44 each formed of a colored transparent film mounted between the outer rim 46 and the center post 42 at a slanted angle between about 3° and about 20°. The annular display unit 40 has a second diameter that has not larger than ½ of the first diameter for the cylindrical body 20.

A mounting aperture or support 50 is provided on the outer peripheral surface 28 of the top rim 26 of the cylindrical body 20 for receiving the center post 42 of the display unit 40 and allowing the display unit 40 to rotate upon an upward movement of heated air from a lighted candle 30.

Figure 3:
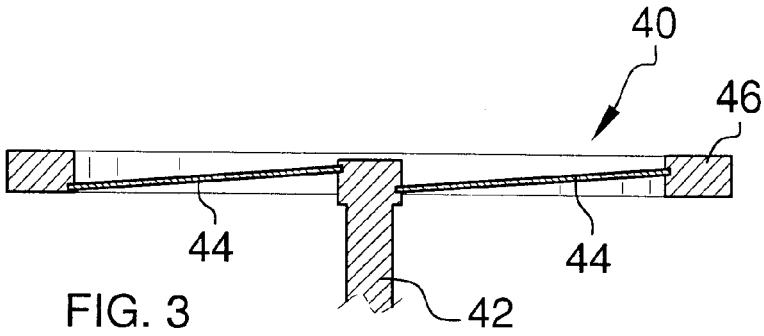
FIG. 3 is a partial, cross-sectional view of the annular display unit for the present invention image projecting candle apparatus.

A partial, cross-sectional view of the annular display unit 40 is shown in FIG. 3. It is seen that the four 90° fan-shaped segments 44 are each mounted between the center post 42 and the rigid outer rim 46 at an angle of approximately between 3° and 20° in order to cause the annular display unit 40 to rotate when heated air 18, shown in FIG. 4, arises from the lighted candle 30.

Figure 4:
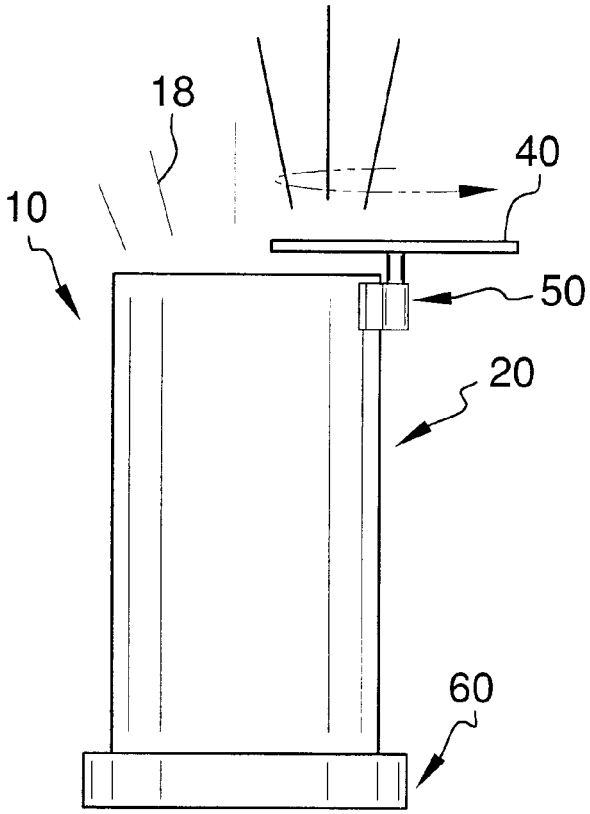
FIG. 4 is a side view of the present invention image projecting candle apparatus.
Figure 5:
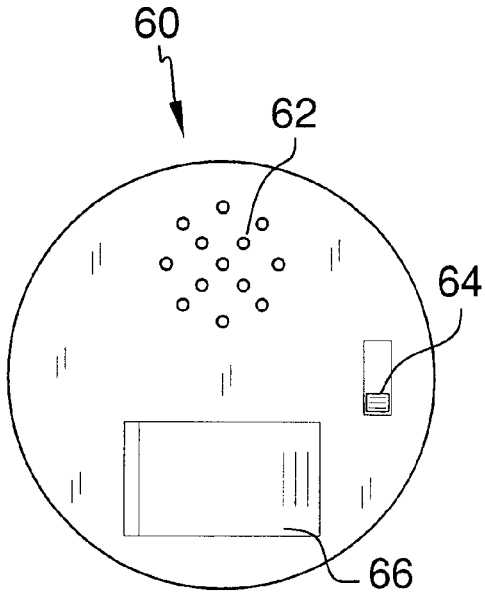
FIG. 5 is a bottom view of the present invention image projecting candle apparatus showing the optional music player.

Optionally, the present invention image projecting candle apparatus 10 may further include a music playing base 60, as shown in FIGS. 4 and 5, which may contain a music player 62, and on/off switch 64 and a battery compartment 66.

In still another alternate embodiment, the present invention image projecting candle may further include a motor (not shown) which is mounted on the base 60 for turning the annular display unit 40 at a preselected rotational speed.

The present invention image projecting candle apparatus has therefore been amply described in the above descriptions and in the appended drawings of FIGS. 1-5.

While the preferred embodiments of the invention have been described above, it will be recognized and understood that various modifications can be made in the invention and the appended claims are intended to cover all such modifications which may fall within the spirit and scope of the invention.

What is claimed is:

1. An image projecting candle comprising:

a generally elongated cylindrical body with a cavity therein and an open top defined by a top rim and a first diameter;

a candle positioned in said cavity;

an annular display unit formed of a rigid outer rim, a center post and four 90° fan-shaped segments each formed of a colored transparent film mounted between said outer rim and said center post at an angle between 3° and 20° from a plane defined by said outer rim, said annular display unit having a second diameter that is not larger than ½ of said first diameter for said cylindrical body;

a mounting aperture on an outer peripheral surface of said top rim of the cylindrical body for receiving said center post of said display unit and allowing said display unit to rotate upon an upward movement of heated air from a lighted candle.

2. The image projecting candle according to claim 1 further comprising a music-playing base.

3. The image projecting candle according to claim 1 further comprising a battery powered motor for turning said annular display unit at a preselected rotational speed.

4. The image projecting candle according to claim 1, wherein said generally elongated cylindrical body is formed of glass.

5. The image projecting candle according to claim 1, wherein said generally elongated cylindrical body is formed of a translucent or opaque plastic material.

6. The image projecting candle according to claim 1, wherein said candle has a height not more than ½ of a height of said cavity.

7. The image projecting candle according to claim 1, wherein said four 90° fan-shaped segments are each slanted at an angle of about 5° between said rigid outer rim and said center post to cause a rotation of said annular display unit by rising heated air rim the cylindrical body.

8. The image projecting candle according to claim 1, wherein said generally elongated cylindrical body further comprising a sports team logo printed on an outside wall of the cylindrical body.

* * * * *